US006569000B1

(12) United States Patent
Mushardt et al.

(10) Patent No.: US 6,569,000 B1
(45) Date of Patent: May 27, 2003

(54) GRINDING MACHINE FOR CENTERLESS GRINDING OF WORKPIECES

(75) Inventors: Heinrich Mushardt, Neu-Boernsen (DE); Torsten Arndt, Leipzig (DE)

(73) Assignee: Schaudt Mikrosa BWF GmbH, Stuttgart (DE)

( * ) Notice: Subject to any disclaimer, the term of this patent is extended or adjusted under 35 U.S.C. 154(b) by 57 days.

(21) Appl. No.: 09/648,021

(22) Filed: Aug. 25, 2000

(30) Foreign Application Priority Data

Aug. 27, 1999 (DE) ..... 199 40 687

(51) Int. Cl.[7] ..... B24B 49/00

(52) U.S. Cl. ..... 451/72; 451/56; 451/243; 451/909; 51/322

(58) Field of Search ..... 451/49, 51, 56, 451/72, 243, 5, 8, 14, 182, 245, 406, 407, 410, 443, 909; 51/165.87, 165.75, 266, 290, 322, 326; 248/DIG. 1

(56) References Cited

U.S. PATENT DOCUMENTS 4,570,386 A * 2/1986 Unno et al. ..... 125/11.03
4,587,763 A * 5/1986 Hahn ..... 451/413
5,674,106 A * 10/1997 Cheetham ..... 451/14
5,928,065 A * 7/1999 Shih ..... 451/243
6,123,605 A * 9/2000 Yano ..... 451/243

FOREIGN PATENT DOCUMENTS

| | | |
|---|---|---|
| EP | 0 448 509 B1 | 2/1991 |
| EP | 0 449 767 A1 | 2/1991 |
| EP | 0 616 870 A1 | 3/1993 |
| WO | WO 96/05940 | 2/1996 |

* cited by examiner

*Primary Examiner*—Joseph J. Hail, III
*Assistant Examiner*—Anthony Ojini
(74) *Attorney, Agent, or Firm*—Weingarten, Schurgin, Gagnebin & Lebovici LLP

(57) ABSTRACT

A grinding machine for centerless grinding of workpieces is provided. The workpieces are disposed on a support in the area of a longitudinal plane of the grinding machine. A first slide is provided for a grinding wheel and positioned laterally relative to the longitudinal plane. A second slide is provided for a regulating wheel and is likewise positioned laterally with respect to the longitudinal plane. A first dressing tool is provided for dressing the grinding wheel at a first predetermined position and a second dressing tool for dressing the regulating wheel at a second predetermined position. The first and second predetermined positions are located in the area of the longitudinal plane.

14 Claims, 4 Drawing Sheets

GRINDING MACHINE FOR CENTERLESS GRINDING OF WORKPIECES

CROSS REFERENCE TO RELATED APPLICATIONS

Reference is made to a first patent application of the same applicant of even date entitled "A method and an apparatus for CNC-controlled dressing of a regulating wheel of a grinding machine for a centerless grinding process on a workpiece, a method for centerless grinding and a grinding machine," U.S. patent application Ser. No. 09/648,207) and to a second patent application of the same applicant of even date entitled "Method and machine for centerless angular plunge grinding," U.S. patent application Ser. No. 09/648, 206), the disclosures of these co-pending applications being incorporated into this application by way of reference.

FIELD OF THE INVENTION

The present application generally relates to the field of grinding workpieces. More specifically, the invention is related to the field of centerless grinding. Still more specifically, the invention is related to a grinding machine for centerless grinding of workpieces disposed on a support in the area of a longitudinal plane of the grinding machine, comprising a first slide for a grinding wheel positioned laterally relative to the longitudinal plane, a second slide for a regulating wheel being likewise positioned laterally with respect to the longitudinal plane, a first dressing tool for dressing the grinding wheel at a first predetermined position and a second dressing tool for dressing the regulating wheel at a second predetermined position.

BACKGROUND OF THE INVENTION

A grinding machine of the type specified before is disclosed in EP 0 448 509 B1.

In this prior art grinding machine the grinding wheel and the regulating wheel are disposed on opposite sides of a longitudinal median plane of the grinding machine, as is conventionally known. In the area of the longitudinal median plane, i.e. between the grinding wheel and the regulating wheel, a support rail is disposed in an axial extension along the longitudinal median plane for supporting the workpieces to be ground. The support rail, as is also well-known per se, is configured sloped at its upper surface. It may be displaced vertically.

The grinding wheel and the regulating wheel together with their associated drives are each disposed on slides. These slides are configured to be displaced both parallel to the longitudinal median plane, along the so-called Z-axis as also along a direction extending under right angles thereto and conventionally designated as X-axis. Moreover, they may be pivoted about a vertical axis.

In this prior art grinding machine, one separate dressing tool each is provided for the grinding wheel on the one hand and for the regulating wheel on the other hand. The dressing tools are positioned on the respective associated slides and extend parallel to the X-axis. The dressing tools engage the grinding wheel and the regulating wheel, respectively, at their respective rear sides, i.e. at the side that is opposite to the longitudinal median plane and, hence, opposite to the workpiece.

The prior art machine has, therefore, the disadvantage that an additional space is necessary on the rear side of the grinding wheel and of the regulating wheel allowing to position the dressing tools in that area. Besides this disadvantage under design aspects, the prior art grinding machine has the essential functional disadvantage that due to the rearward position of the dressing tools precision problems may be generated. These problems are generated on the one hand due to temperature variations as a consequence of different expansions of machine sections, but in particular when the grinding wheel and/or the regulating wheel are pivoted about the vertical axis (so-called B-axis) and/or about an axis (so-called A-axis) extending parallel to the X-axis. These pivotal movements are necessary because the axial feed force is generated by pivoting the regulating wheel about the A-axis, whereas pivoting the regulating wheel about the B-axis the workpiece is directed radially relative to the grinding wheel so as to allow predetermining a desired cylindrical or conical shape.

If now the grinding wheel and the regulating wheel are dressed "from behind", geometric errors are inevitably generated when errors occur during the pivotal movement about the A-axis and/or the B-axis. These dressing errors, in turn, result in contour errors on the worked workpieces which, again, can only be corrected by a complicated iterative readjustment of the A-axis and the B-axis.

WO 96/05940 discloses an external cylindrical surface grinding machine in which the workpieces are chucked between tips. In this prior machine tool, two grinding wheels are provided one besides of the other. The two grinding wheels together with their associated drives are each seated on a separate slide. The slides, in turn, may be displaced along the X- and the Z-direction.

Both slides of this prior art grinding machine are provided with dressing rollers. By appropriately advancing and retracting the dressing rollers and by approaching the two slides with respect to each other, the dressing roller on the one slide will dress the grinding wheel on the other slide and vice versa. However, also in this prior art grinding machine the dressing rollers are positioned on the rear side of the grinding wheels, i.e. on the side opposite the workpiece.

For that reason also this prior art grinding machine has the disadvantage mentioned above.

Another grinding machine for centerless grinding is disclosed in EP 0 616 870 A1. In this prior art grinding machine, dressing tools for the grinding wheel and the regulating wheel, respectively, are positioned in front of the slide carrying the grinding wheel and its associated drive. One of the dressing tools is stationary and the other dressing tool may be transported on the respective other slide.

Further, EP 0 449 767 A1 discloses a grinding machine for centerless grinding of still more conventional design having dressing tools on the side of the grinding wheel and the regulating wheel, respectively, opposite the center median plane.

It is, therefore, an object underlying the invention to improve a grinding machine of the type specified at the outset and being intended to be used for centerless grinding of workpieces, such that the disadvantages mentioned above are avoided. In particular, the dressing of the grinding wheel and/or of the regulating wheel shall become possible without sacrificing further space on the machine. In particular, the invention shall make it possible to perform dressing on the wheels without any contour errors on the workpiece at all or with only negligible such contour errors, even if the machine is subjected to varying temperatures and/or positioning errors should occur during the pivotal movement about the A- and/or B-axis.

SUMMARY OF THE INVENTION

According to the grinding machine specified at the outset, this object is achieved in that the positions are located in the area of the longitudinal plane.

The object underlying the invention is thus entirely solved. If, namely, the positions are in the area of the longitudinal plane, this means that the dressing process occurs in the area of engagement of the wheels (grinding wheel and regulating wheel), i.e. essentially at the point where the two wheels are in contact with the workpiece during a machining operation.

This has the essential advantage that the entire assembly is concentrated in the area of the longitudinal median plane, in particular in front of the wheels, so that no additional space is required behind the grinding wheels and their associated drives, respectively. Above all, the invention has the advantage that the contour errors explained above are minimized and, mostly, entirely eliminated because the dressing operation is effected at a position where the later engagement of the workpiece takes place. Therefore, for simply geometric reasons no errors of the type discussed above may occur.

The precision of the grinding machine may, hence, be substantially improved with relatively simple design measures.

In preferred embodiments of the invention, the longitudinal plane is the longitudinal median plane of the grinding machine, wherein, as known per se, the slides may be disposed on opposite sides of the longitudinal median plane.

This measure has the advantage that the dressing tools are disposed between opposite wheels so that no further space is required.

In further embodiments of the invention, kinematic variations and inversions of the sequence of motion of the various elements involved are possible.

For example, according to an embodiment of the invention, it is possible to make the first and/or the second dressing tool displaceable.

According to a first variation of this embodiment, this is made by disposing the first and/or the second dressing tool on a third slide which, preferably, is adapted to be displaced along an axis extending parallel to the longitudinal plane.

This measure has the advantage that the dressing movement is effected along the Z-axis by displacing the third slide, so that the first and the second slide for the grinding wheel and for the regulating wheel must not be displaced during the dressing operation. It is particularly preferred in this context when the two slides are not adapted to be displaced at all along the Z-axis which is sufficient for many applications with respect to the processing of the workpieces so that a substantial simplification of the machine is obtained which, in turn, results in lower manufacturing costs.

According to another variant of this embodiment, the first and/or the second dressing tool may, however, also be disposed on the respective other slide, i.e. the first dressing tool may be disposed on the second slide and/or the second dressing tool may be disposed on the first slide.

This measure has the advantage that the dressing process is effected by simply utilizing machine axes so that no separate drives are necessary for the dressing assembly (separate dressing axis or axes, respectively).

According to another modification of this variant, the respective dressing tool is disposed on a movable arm such that the dressing tool preferably is positioned within the peripheral contour of the regulating wheel or the grinding wheel, respectively, and outside that peripheral contour when in a dressing position.

This measure has the advantage that the sequence of motion may be simplified and that collisions between the dressing tool and the respective other slide or the respective other dressing tool or the workpiece may be avoided because when the dressing tool is not needed, it will be displaced into its retracted position.

In this embodiment it is further preferred when the arm is adapted to be pivoted about an axis or is adapted to be shifted along an axis.

It had already been mentioned that the displaceability of the dressing tools on the one hand and of the slides on the other hand depend on each other. In any case it is necessary to ensure a relative displaceability with respect to the X-axis and the Y-axis.

If, according to the above-discussed embodiments of the invention, the dressing tools are disposed on the slide and the dressing operation is executed by reciprocally approaching the slides relative to one another, similarly as discussed in WO 96/05940 discussed at the outset, it is necessary that the slides are adapted to be displaced not only along the Z-axis but also along the X-axis.

According to further embodiments of the invention, the first dressing tool is disposed stationarily and the first slide is adapted to be displaced along a first axis extending parallel to the longitudinal plane as well as along a second axis extending under right angles relative to the longitudinal plane.

This measure, too, has the advantage that the dressing operation may be executed solely by making displacements along the machine axes without the necessity of separate dressing axes.

According to this embodiment of the invention it is further preferred when the first and/or the second dressing tool and the support are structurally integrated on a common console.

This measure has the advantage that the components that are provided in the area of the longitudinal median plane anyway, are utilized for several purposes, namely when the console is utilized for supporting the support on the one hand and, on the other hand, serves as a basis for one or two dressing tools.

Correspondingly or alternatively or in addition, the machine may be configured such that the first and/or the second dressing tool together with a feeding assembly for the workpieces are structurally integrated on a common console.

According to further embodiments of the invention, it is preferred when the axes of the grinding wheel and of the regulating wheel lie in the same plane as the points of engagement of the dressing tools on the grinding wheel and on the regulating wheel.

This measure has the advantage already mentioned at the outset that a very high precision may be obtained when the grinding wheel and the regulating wheel are dressed exactly at the same position where they come into engagement with the workpiece at a later moment in time.

The same holds true if according to a preferred variation of this embodiment, as known per se, the plane is disposed below the points of engagement of the grinding wheel and the regulating wheel on the workpiece by a predetermined amount. In exceptional cases, however, it may also be disposed above these points of engagement.

Moreover, embodiments of the invention are preferred in which not two separate dressing tools are utilized but, instead, the first and the second dressing tool are structurally integrated into a common dressing tool.

This method has the advantage that the machine is less complicated and the dimensions of the grinding machine may be reduced.

The grinding machine according to the present invention may be used for various centerless grinding processes, namely for external cylindrical surface grinding, internal cylindrical surface grinding, plunge grinding or angular plunge grinding.

It goes without saying that the features mentioned before and those that will be explained hereinafter, may not only be used in the particularly given combination, but also in other combinations or alone, without leaving the scope of the present invention.

BRIEF DESCRIPTION OF THE DRAWINGS

Embodiments of the invention are shown in the drawing and will be discussed in further detail in the subsequent description.

DETAILED DESCRIPTION OF THE PREFERRED EMBODIMENTS

Figure 1:
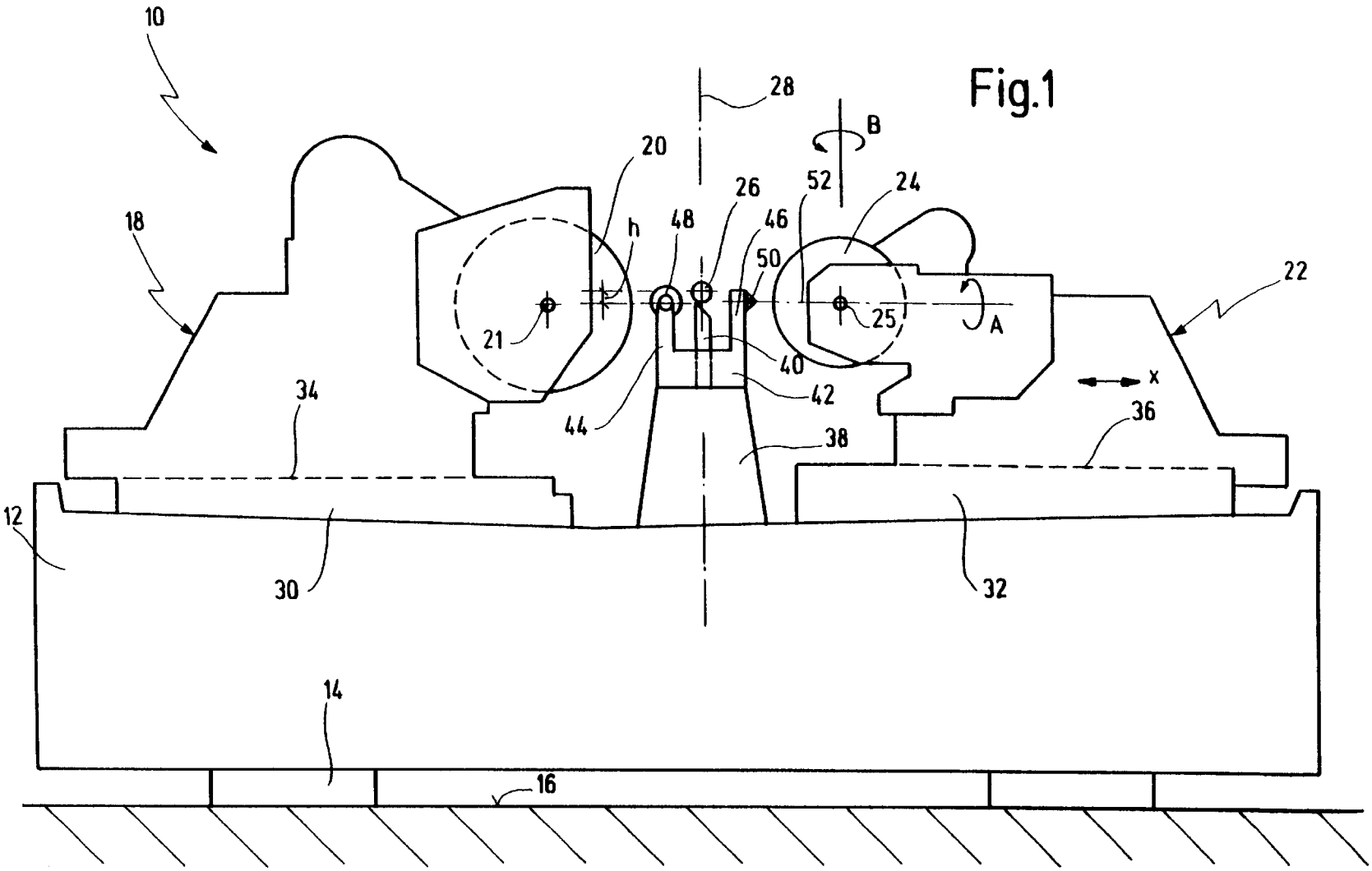
FIG. 1 shows a highly schematic side elevational view of a first embodiment of a grinding machine according to the invention, for centerless external cylindrical surface grinding.
Figure 3:
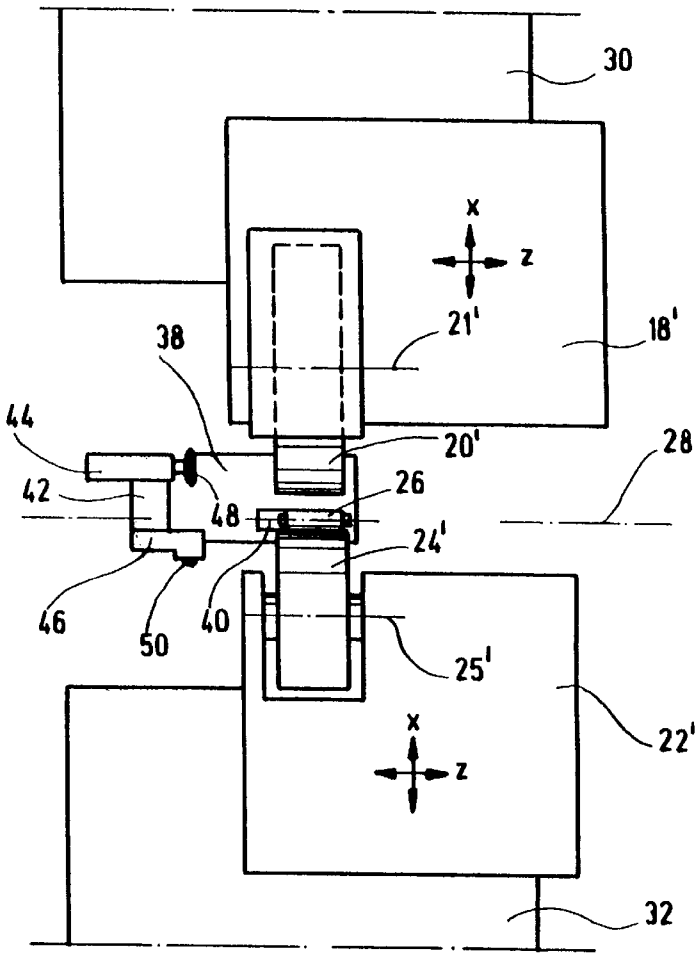
FIGS. 2 and 3 show further schematic top plan views of the machine of FIG. 1 in a dressing position (FIG. 2) and in a working position (FIG. 3)
Figure 2:
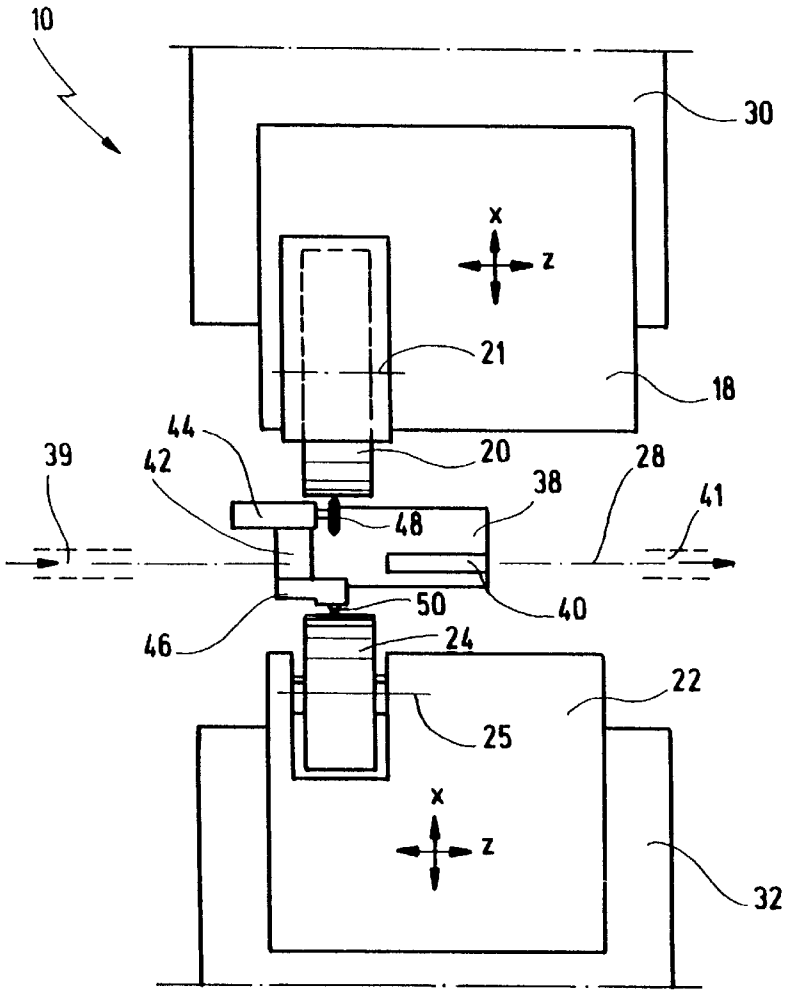

In FIGS. 1 to 3 reference numeral 10 as a whole designates a grinding machine for centerless external cylindrical surface grinding of workpieces. Grinding machine 10 rests on a machine bed 12 which, in turn, is supported via feed 14 on a floor 16. On machine bed 12 a first slide 18 is disposed carrying a grinding wheel 20 with its associated drive (not shown). Grinding wheel 20 is rotatable about a first axis 21.

A second slide 22 carries a regulating wheel 24 being rotatable about a second axis 25, as well as the associated drives (not shown).

A workpiece 26 is positioned between wheels 20 and 24, in the area of a longitudinal median plane 28 of grinding machine 10.

Slides 18 and 22 are supported on cross slides 30 and 32, as indicated at 34 and 36.

According to the nomenclature used in the grinding machine industry, both slides 18 and 22 are adapted to be displaced along a Z-axis extending parallel to the longitudinal median plane 28, as well as along a X-axis extending under right angles thereto. The corresponding axes are depicted in the top plan views of FIGS. 2 and 3. In the technology of grinding machines for centerless grinding of workpieces, it is, further, wellknown to at least pivot regulating wheel 24 about an axis A extending parallel to the X-axis. Moreover, another pivotal movement about a vertical B-axis also extending under right angles thereto, is well-known. For illustration purposes, axes A and B are shown in FIG. 1.

If regulating wheel 24 is pivoted about the A-axis, an axial feed force is generated relative to workpiece 26 by means of which the workpieces 26 are axially transported during through-feed grinding, namely through the grinding gap between grinding wheel 20 and regulating wheel 24. Pivoting regulating wheel 24 about the B-axis effects that workpieces 26 are aligned radially relative to grinding wheel 20, thus permitting to predetermine a desired cylindrical or conical shape.

A console 38 is located between slides 18, 22, i.e. in the area of longitudinal median plane 28. Console 38 extends along longitudinal median plane 28. Console 38 at its input is connected to a feeding assembly 39 for workpieces 26, as indicated in FIG. 2 in dashed lines, or is structurally integrated with same.

Console 38 on its upper side carries a support rail 40 which, as is known per se, is configured with a slope on its upper surface. Support rail 40, as clearly shown in FIG. 1, carries workpieces 26.

On the side of console 38 opposite feeding assembly 39, a corresponding discharge assembly 41 is arranged in Z-direction. Discharge assembly 41 receives finished workpieces 26 during through-feed grinding and transports same away. Discharge assembly 41, too, may be structurally integrated with console 38.

It goes, however, without saying that workpieces 26 may also be brought otherwise into the area of support rail 40 and brought away therefrom, respectively. Feeding assembly 39 as well as discharge assembly 41 may be entirely separate units having no mechanical connection to console 38 whatsoever.

Further, a stand 42 clearly shown in FIG. 1 is positioned on console 38. Stand 42 has a U-shaped cross-section. Two parallel arms 44 and 46 extend vertically and upwardly from stand 42. A first arm 44 carries a first dressing tool 48 for the grinding wheel 20. A second arm 46, in contrast, carries a second dressing tool 50 for dressing the regulating wheel 24.

As one may further see from FIG. 1, axes 21 and 25 of grinding wheel 20 and regulating wheel 26 lie in the same, essentially horizontal plane 52. The points of engagement of dressing tools 48 and 50, when they engage grinding wheel 20 and regulating wheel 24, respectively, preferably also lie within that plane 52.

In contrast thereto, the axis of workpiece 26 is indicated somewhat above plane 52, as indicated in FIG. 1 with a vertical offset H. This measure is well-known in the technology of centerless grinding of workpieces and needs not to be further discussed in detail in the present context.

In grinding machine 10 according to FIGS. 1 to 3, therefore, dressing tools 48 and 50 are stationary, namely in the shown embodiment in that they are rigidly mounted on the stationary console 38. However, it goes without saying that dressing tools 48 and 50 may also be disposed in the area of the feeding assembly 39 or of the discharge assembly 41.

If dressing tools 48 and 50 are stationary, the dressing operation must be executed by corresponding displacement of the wheels 20 and 24 to be dressed. In the embodiment shown in FIGS. 1 to 3, this does not present any problems because wheels 20 and 24 are adapted to be displaced on their slides 18 and 22 along the Z-axis as well as along the X-axis.

FIG. 2 shows a dressing operation for which slides 18 and 22 are displaced sufficiently to the left hand side by displacing same along the Z-axis. Simultaneously, slides 18 and 22 are approached along the X-direction towards dressing tools 48 and 50 so that these come into engagement with the surface of wheels 20 and 24. Wheels 20 and 24 may now be dressed such that they are displaced along dressing tools 48 and 50 once or several times by displacing slides 18 and 22 along the Z-direction and by being in engagement with the latter.

As soon as the dressing operation according to FIG. 2 is terminated, wheels 20 and 24 are driven away from dressing tools 48 and 50 along the X-direction and, in the embodiment shown, may be displaced to the right hand side with their slides 18 and 22 for then working on a workpiece 26 that had been made ready in the meantime on support rail 40. In FIG. 3 all displaced or shifted components are designated with their reference numeral to which an apostrophe was added.

Figures 4, 5, 6:
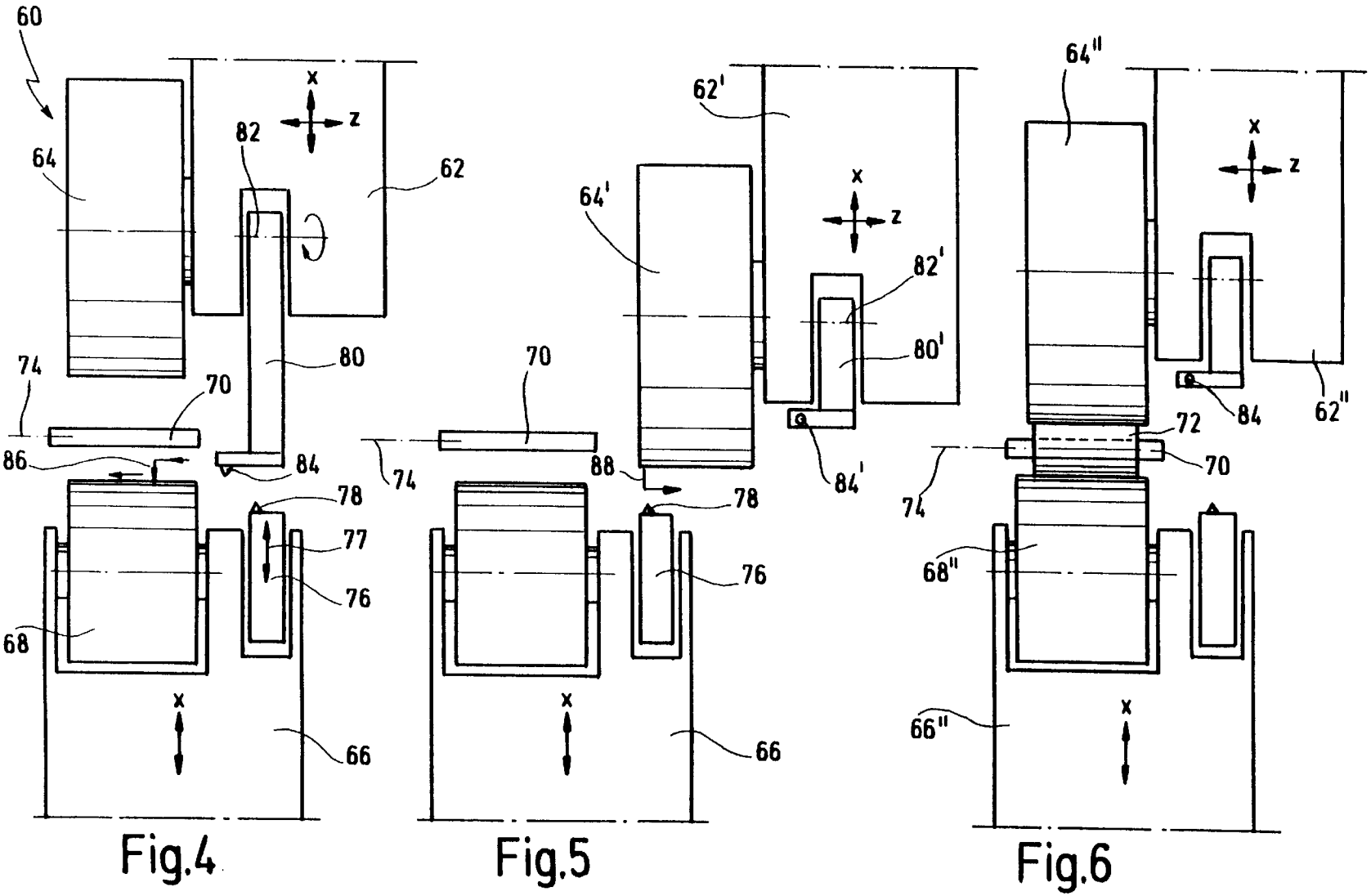
FIGS. 4 to 6 show top plan views, similar to those of FIGS. 2 and 3, on another embodiment of an external cylindrical surface grinding machine according to the invention, in three separate operational positions.

In FIGS. 4 to 6 a second embodiment of a grinding machine according to the present invention is designated with reference numeral 60. Grinding machine 60 again has a first slide 62 for a grinding wheel 64 as well as a second slide 66 for a regulating wheel 68. A support rail 70 is also provided between wheels 64 and 68 for supporting workpieces 72 to be machined (FIG. 6). Support rail 70 extends along a longitudinal median plane 74 of grinding machine 60.

A first arm 76 is disposed on second slide 66. First arm 76 is adapted to be shifted in the direction of an axis 77 extending parallel to the X-axis. First arm 76 at its front side carries a first dressing tool 78 for dressing grinding wheel 64.

A second arm 80 is disposed on first slide 62 and is adapted to be pivoted about an axis 82. Axis 82 extends parallel to the Z-axis. Second arm 80 carries a second dressing tool 84 for dressing regulating wheel 68.

In the operational position shown in FIG. 4 grinding wheel 64 and regulating wheel 68 face each other. Second arm 80 on first slide 62 is in its extended position and protrudes far beyond the peripheral contour of grinding wheel 64. In that position first slide 62 may be displaced with the left hand side in FIG. 4, i.e. along the Z-axis and may then be displaced downwardly along the X-axis, as indicated with arrows 86. By doing so it becomes possible to dress regulating wheel 68 at its periphery alone by displacing first slide 62. Of course, the X-displacement may, as an alternative, also be effected by displacing second slide 66 in the X-direction.

Considering that first slide 62 is adapted to be displaced both in the X- and in the Z-direction, it is only necessary in the grinding machine 60 of FIGS. 4 to 6 for second slide 66 that it is adapted to be displaced along the X-axis. It is not necessary to make it displaceable also along the Z-axis.

In order to also enable to dress grinding wheel 64, first slide 62 is displaced to the right hand side along the Z-axis, as shown in FIG. 5. In FIG. 5 all displaced elements are designated with the same reference numerals as in FIG. 4, however, an apostrophe is added.

Grinding wheel 64' now faces first arm 76 with first dressing tool 78. First slide 62' is now displaced downwardly along the X-direction until first dressing tool 78 comes into engagement with the peripheral surface of grinding wheel 64'. Subsequently, first slide 62' is displaced with the left hand side in the Z-direction, such that first dressing tool 78 runs along the outer periphery of grinding wheel 64. For that purpose, first arm 76, if need be, may:also be extended in the direction of axis 77 in the X-direction upwardly.

As an alternative, the X-movement may also be configured by correspondingly displacing second slide 66.

From FIG. 5 one may further see that second arm 80' was pivoted away about axis 82' so that second dressing tool 64' is now within the peripheral contour of grinding wheel 64' and, hence, is no obstacle when grinding wheel 64 is displaced.

Finally, FIG. 6 shows a third operational position of grinding machine 60'. In FIG. 6 the moved elements are designated with their reference numeral and a double apostrophe is added.

As one can see, grinding wheel 64" and regulating wheel 68' again face each other and enclose between them workpiece 72 on support rail 70. Workpiece 72, hence, is in contact with both wheels 64" and 68". The necessary feeding movement along the X-direction is effected by displacing both slides 62" and 66".

Figure 7:
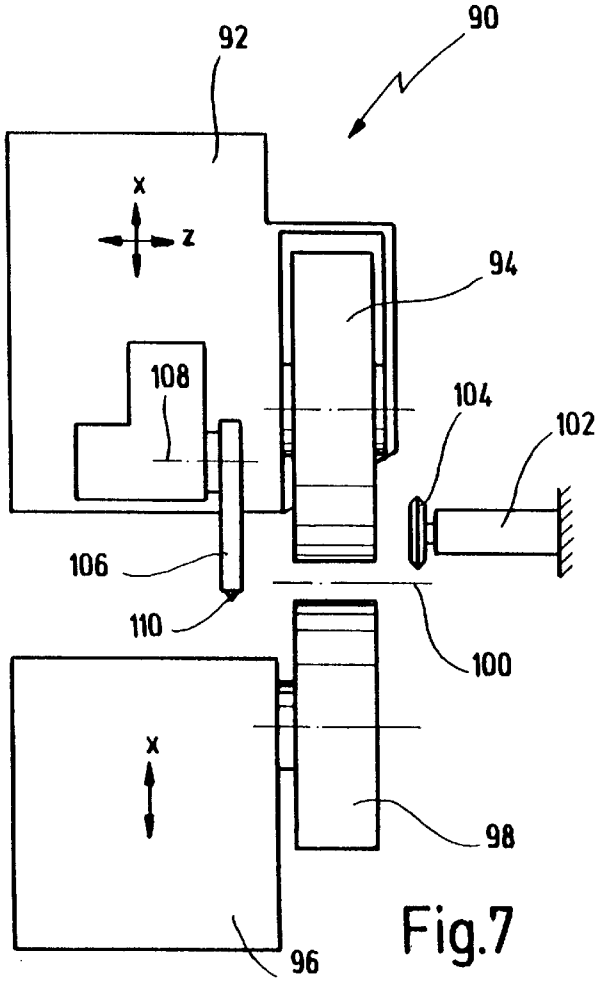
FIG. 7 shows a further top plan view, similar to that of FIGS. 2 to 6, however, for a third embodiment of the invention.

FIG. 7 shows a third embodiment of a grinding machine 90 according to the invention, having a first slide 92, carrying a grinding wheel 94 as well as a second slide 96 carrying a regulating wheel 98.

As was the case with grinding machine 60 of FIGS. 4 to 6, the operational conditions for grinding machine 90 of FIG. 7 are also such that first slide 62 for grinding wheel 94 is adapted to be displaced both in the X- and in the Z-direction, whereas second slide 96 for regulating wheel 98 may only be displaced along the X-direction.

In FIG. 7 reference numeral 100 again designates a longitudinal median plane of grinding machine 90.

A first arm 102 is disposed stationarily in the area of longitudinal median plane 100. First arm 102 carries a first dressing tool 104 for grinding wheel 94.

A second arm 106, in contrast, is disposed on first slide 92 and is, hence, adapted to be displaced. Second arm 106 is adapted to be pivoted about an axis 108 extending parallel to the Z-axis. Second arm 106 carries a second dressing tool 110 for the regulating wheel 108.

As one can easily see from FIG. 7, the periphery of grinding wheel 94 may easily be approached to first grinding tool 104 for dressing grinding wheel 94 by displacing first slide 92 in the X- and in the Z-direction. The dressing movement is then again exclusively effected by means of the machine axes of first slide 92. Second arm 106 is preferably pivoted away from the position shown in FIG. 7 by pivoting same about axis 108, such that it does not protrude beyond the peripheral contour of grinding wheel 94 in the X-direction.

For dressing regulating wheel 98, second arm 106, in contrast, is extended into the position shown in FIG. 7. Second dressing tool 110 may then be brought into engagement with the outer periphery of regulating wheel 98 in the manner already described by displacing first slide 92 in the X- and in the Z-direction. Again, as an alternative, the X-displacement may be effected also by second slide 96.

Figure 8:
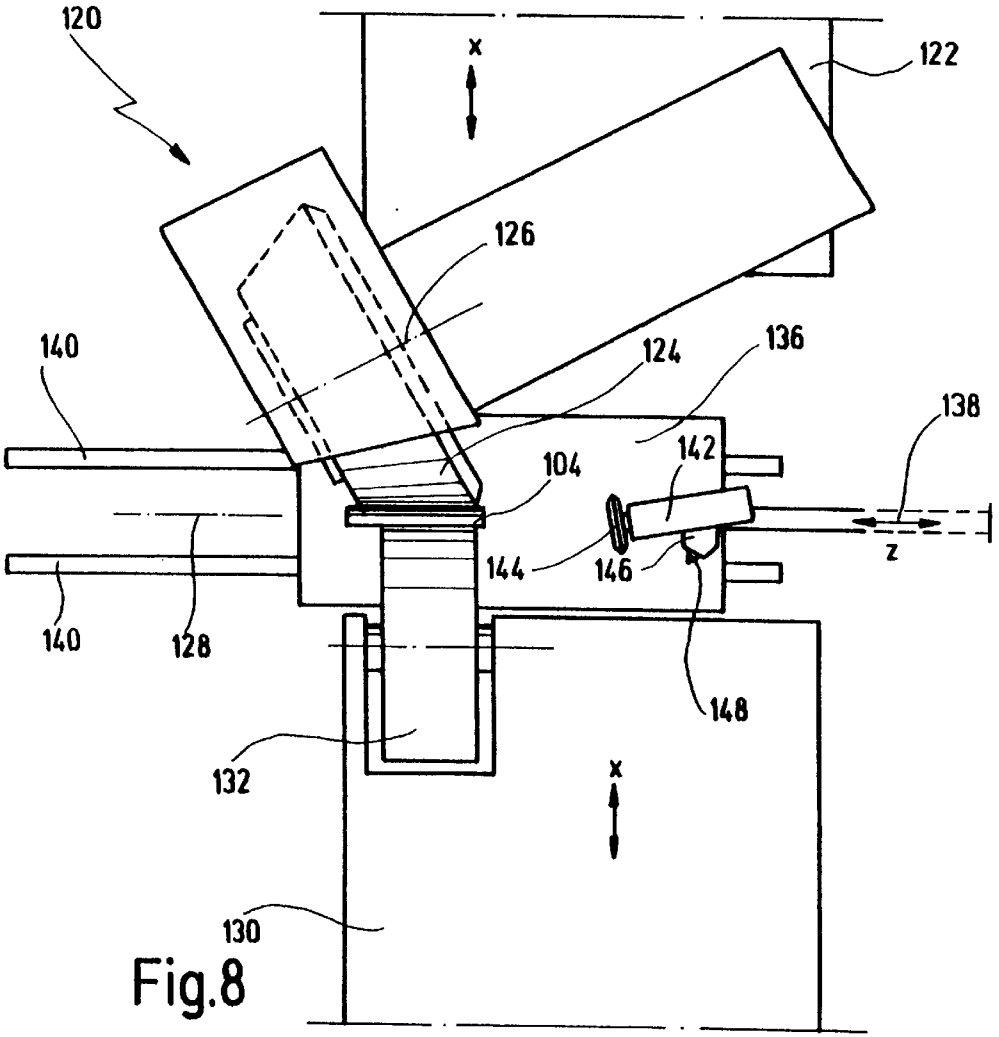
FIG. 8 shows another depiction, similar to that of FIGS. 2 to 7, for a fourth embodiment of the invention.

Whereas in the embodiments of FIGS. 1 to 7 described hereinbefore, the grinding machines 10, 60 and 90 were each used for a centerless external cylindrical surface grinding, FIG. 8 shows a fourth embodiment of a grinding machine 120 used for centerless angular infeed grinding.

Grinding machine 120 comprises a first slide 122 with a grinding wheel 124, the axis 120 of which extends under an angle to the longitudinal median plane 128 of grinding machine 120. Grinding wheel 124, therefore, has the conventional conical design as is typical for angular infeed grinding machines.

A second slide 130 carries the regulating wheel 132. A workpiece 134 is positioned between grinding wheel 124 and regulating wheel 132. Workpiece 134 is disposed on a support (not shown) which, again, is mounted on a third slide 136. Third slide 136 is adapted to be displaced along the Z-direction. In contrast, slides 122 and 130 may only be displaced along the X-direction.

For displacing third slide 136, a linear drive 138, also shown highly schematically, is provided which, for example, may comprise a ball screw spindle or the like. Third slide 136 runs on rails 140.

A first arm 142 is mounted on third slide 136. First arm 142 carries a first dressing tool 144 for the grinding wheel 124. Moreover, a second arm 146 is also mounted on third slide 136. Second arm 146 carries a second dressing tool 148 for regulating wheel 132.

In the grinding machine 120 of FIG. 8 the dressing operation is executed by displacing the wheel to be dressed along the X-direction by suitably displacing its corresponding slide, whereas the dressing movement as such is executed by displacing third slide 136 along the Z-direction.

As one may easily take from the preceding description, all kinematic configurations are possible with respect to the grinding wheel, regulating wheel and the two grinding tools, namely the displaceability along two axes, along one axis or a stationary mounting. All these alternatives may be configured in all conceivable permutations. The important point is that the dressing axes are always configured by corresponding displacement units, i.e. a feeding movement in the X-direction and a dressing movement in the Z-direction. Insofar, it is meaningless that in a particular case further motional axes may be provided for individual assemblies.

Within the scope of the present invention, it is, above all, important that the dressing tools are disposed in the area of the longitudinal median plane and, hence, engage the dressing wheel and the regulating wheel from the inside at any time, i.e. from the space between these two wheels.

With respect to the various embodiments it was also shown that the grinding machine of the present invention may be utilized for various grinding operations within the field of centerless grinding, i.e. for external cylindrical surface grinding, for internal cylindrical surface grinding, for plunge grinding and for angular plunge grinding.

What is claimed is:

1. A grinding machine for centerless grinding of workpieces disposed on a support in the area of a longitudinal plane of said grinding machine comprising:

a first slide for a grinding wheel positioned laterally relative to said longitudinal plane, said first slide being adapted to be displaced along a first axis extending parallel to said longitudinal plane as well as along a second axis extending under right angles to said longitudinal plane;

a second slide for a regulating wheel being likewise positioned laterally with respect to said longitudinal plane, said second slide being adapted to be displaced along said first axis as well as along said second axis;

a first dressing tool for dressing said grinding wheel at a first predetermined position, said first dressing tool being disposed stationarily; and a second dressing tool for dressing said regulating wheel at a second predetermined position, said second dressing tool being likewise disposed stationarily, wherein said positions are located essentially within said longitudinal plane, and a device for executing a dressing operation by corresponding displacement of said grinding wheel and said regulating wheel relative to said first and second dressing tools that are stationarily disposed.

2. The grinding machine of claim 1, wherein said longitudinal plane is a longitudinal median plane of said grinding machine, said slides being disposed on opposite sides of said longitudinal median plane.

3. The grinding machine of claim 1, wherein said first dressing tool and said support are structurally integrated on a common console.

4. The grinding machine of claim 1, wherein said first dressing tool and a feeding assembly are structurally integrated on a common console.

5. The grinding machine of claim 1, wherein said second dressing tool and said support are structurally integrated on a common console.

6. The grinding machine of claim 1, wherein said second dressing tool and a feeding assembly for said workpiece are structurally integrated on a common console.

7. The grinding machine of claim 1, wherein said grinding wheel and said regulating wheel, respectively, have axes, said axes lying within a plane, points of engagement of said dressing tools on said grinding wheel and on said regulating wheel, respectively, also lying within said plane.

8. The grinding machine of claim 7, wherein said points of engagement lie in an area between said grinding wheel and said regulating wheel.

9. The grinding wheel of claim 7, wherein said plane is disposed below said points of engagement of said grinding wheel and said regulating wheel on said workpiece by a predetermined amount.

10. The grinding wheel of claim 1, wherein said first and said second dressing tools are structurally integrated into a common dressing tool.

11. The grinding machine of claim 1, wherein said machine is configured for centerless external cylindrical surface grinding.

12. The grinding machine of claim 1, wherein said machine is configured for centerless internal cylindrical surface grinding.

13. The grinding machine of claim 1, wherein said machine is configured for centerless plunge grinding.

14. The grinding machine of claim 1, wherein said machine is configured for centerless angular plunge grinding.

* * * * *